US005694076A

United States Patent [19]

Ishibashi

[11] Patent Number: 5,694,076

[45] Date of Patent: Dec. 2, 1997

[54] VOLTAGE GENERATION CIRCUIT WITH OUTPUT FLUCTUATION SUPPRESSION

[75] Inventor: Atsuhiko Ishibashi, Tokyo, Japan

[73] Assignee: Mitsubishi Denki Kabushiki Kaisha, Tokyo, Japan

[21] Appl. No.: 622,269

[22] Filed: Mar. 27, 1996

[30] Foreign Application Priority Data

Oct. 16, 1995 [JP] Japan ..... 7-267229

[51] Int. Cl.[6] ..... G05F 1/10

[52] U.S. Cl. ..... 327/541; 327/543; 327/546; 323/316

[58] Field of Search ..... 327/538, 540, 327/541, 543, 545, 546; 323/313, 315, 316

[56] References Cited

U.S. PATENT DOCUMENTS

| | | | |
|---|---|---|---|
| 4,585,955 | 4/1986 | Uchida | 327/541 |
| 5,249,155 | 9/1993 | Arimoto et al. | 327/542 |
| 5,300,823 | 4/1994 | Ihara | 327/544 |
| 5,426,616 | 6/1995 | Kajigaya et al. | 327/543 |

FOREIGN PATENT DOCUMENTS 59-110225 6/1984 Japan .

*Primary Examiner*—Terry Cunningham
*Attorney, Agent, or Firm*—Oblon, Spivak, McClelland, Maier & Neustadt, P.C.

[57] ABSTRACT

An NMOS transistor (2) has a source electrode, a drain electrode and a gate electrode which are connected to a power source (VSS), an output terminal of a stepdown circuit (27), and a node (N2) between load elements (11, 12) respectively. The transistor size of the NMOS transistor (2) is so set that its drain current exerts no influence on fluctuation of an output voltage (VDD2) when an output voltage control operation by a differential amplification circuit (29) and the stepdown circuit (27) is functional to enable suppression of fluctuation of the output voltage (VDD2), while the output voltage (VDD2) is stepped down on the basis of the current quantity of the drain current of the NMOS transistor (2) when the output voltage control operation is unfunctional to disable suppression of fluctuation of the output voltage (VDD2). Thus, obtained is a voltage generation circuit which can reliably suppress fluctuation of the output voltage regardless of the frequency of fluctuation in source voltage.

16 Claims, 7 Drawing Sheets

VOLTAGE GENERATION CIRCUIT WITH OUTPUT FLUCTUATION SUPPRESSION

BACKGROUND OF THE INVENTION

1. Field of the Invention

The present invention relates to a power circuit which is employed in the interior of a semiconductor integrated circuit device for stepping down a voltage which is applied from the exterior as a power source and supplying the same to the integrated circuit.

2. Description of the Background Art

FIG. 10 shows an exemplary structure of a semiconductor integrated circuit 20 loaded with a power circuit which is described in Japanese Patent Laying-Open Gazette No. 59-110225 (1984), for example. As shown in FIG. 10, the semiconductor integrated circuit 20 is formed by a power circuit 21 and a logic circuit 22, while the power circuit 21 is formed by a constant voltage generation circuit 28 and a differential amplifier 29. Numeral 23 denotes a VCC terminal, and numeral 24 denotes a VSS terminal. On the other hand, the logic circuit 22 is supplied with an output voltage VDD2 from the power circuit 21 and receives an input signal from an input/output terminal 25 (26), for carrying out a prescribed logic operation and outputting an output signal from the input/output terminal 25 (26).

The power circuit 21 outputs the output voltage VDD2, which is lower in potential and smaller in fluctuation than a source voltage VCC, from sources (voltages) VCC and VSS which are supplied from the exterior through the VCC and VSS terminals 23 and 24 respectively. This output voltage VDD2 is employed as a power source for driving the logic circuit 22.

FIG. 11 shows an exemplary internal structure of the power circuit 21 described above with reference to FIG. 10. As shown in FIG. 11, the power circuit 21 is formed by a stepdown circuit 27, the constant voltage generation circuit 28 and the differential amplifier 29.

The constant voltage generation circuit 28 is formed by a load element 31 and a plurality of diodes D1 to Dn which are connected in series between the power sources VCC and VSS, for outputting a constant voltage V28 from a node N1 between the load element 31 and the diode D1. The stepdown circuit 27 is formed by a PMOS transistor 33 having a source which is connected to the power source VCC, so that a voltage which is obtained from a drain of the PMOS transistor 33 forms the output voltage VDD2.

The differential amplifier 29 comprises positive (+) and negative (−) input terminals and an output terminals so that the output terminal is connected to a gate of the PMOS transistor 33 of the stepdown circuit 27 while the constant voltage V28 outputted from the constant voltage generation circuit 28 and the output voltage VDD2 of the stepdown circuit 27 are applied to the negative (−) and positive (+) input terminals respectively. Numeral 22 denotes the logic circuit which is supplied with the output voltage VDD2 of the power circuit.

The operation of the power circuit shown in FIG. 11 is now described. When the load element 31 and the plurality of diodes D1 to Dn are connected in series between the power sources VCC and VSS, a potential difference of a value obtained by multiplying the number n of the diodes D1 to Dn by the threshold voltage of the diode D1 is developed across the node N1 between the load element 31 and the diode D1 and the power source VSS, due to such a property of a diode element that a current flows therein when a voltage exceeding a threshold voltage (about 0.8 V per element) is applied across the element. Consequently, the constant voltage generation circuit 28 outputs the constant voltage V28 at a constant potential which is independent of potential fluctuation of the power source VCC.

The differential amplifier 29 compares the constant voltage V28 of the constant voltage generation circuit 28 which is applied to the negative (−) input terminal with the output voltage VDD2 of the stepdown circuit 27 which is applied to the positive (+) input terminal, for reducing the potential of the output terminal when the output voltage VDD2 is lower than the constant voltage V28 while increasing the potential of the output terminal when the former is higher than the latter.

The stepdown circuit 27 steps down the source voltage VCC (level-shifts the same toward the source voltage VSS), and outputs the output voltage VDD2. When the output potential of the differential amplifier 29 is reduced, a drain current flowing in the PMOS transistor 33 is increased to increase the potential of the output voltage VDD2. When the output potential of the differential amplifier 29 is increased, on the other hand, the drain current flowing in the PMOS transistor 33 is reduced to reduce the potential of the output voltage VDD2. The aforementioned control is regularly performed by the differential amplifier 29, whereby the power circuit 21 can continuously output the output voltage VDD2 which is constant and lower than the source voltage VCC regardless of fluctuation of the voltage across the power sources VCC and VSS supplied from the exterior.

FIG. 12 is a circuit diagram showing an exemplary internal structure of the differential amplifier 29 described above with reference to FIG. 11. The differential amplifier 29 is formed by NMOS transistors 41 to 43 and PMOS transistors 44 and 45. A source electrode of the NMOS transistor 41 is connected with the power source VSS, while a constant voltage 50 is applied to its gate electrode so that the NMOS transistor 41 operates as a constant current element.

On the other hand, source electrodes of the NMOS transistors 42 and 43 are connected with the NMOS transistor 41, while gate electrodes thereof are connected to the positive (+) and negative (−) input terminals of the differential amplifier 29 respectively. The PMOS transistors 44 and 45 have source electrodes which are connected with the power source VCC, gate electrodes which are connected with the drain electrode of the PMOS transistor 44, and drain electrodes which are connected with those of the NMOS transistors 42 and 43 respectively. Further, a node between drain electrodes of the PMOS transistor 45 and NMOS transistor 43 are connected with an output terminal 46 of the differential amplifier 29.

When the potential of the positive (+) input terminal is reduced as compared with that of the negative (−) input terminal in the differential amplifier 29 shown in FIG. 12, the currents flowing into the drain electrodes of the PMOS transistors 44 and 45 are reduced, whereby the potential of the output terminal 46 is reduced beyond the potential difference between the negative (−) and positive (+) input terminals. When the potential of the positive (+) input terminal is increased as compared that of the negative (−) input terminal, on the other hand, the currents flowing into the drain electrodes of the PMOS transistors 44 and 45 are increased, whereby the potential of the output terminal 46 is increased beyond the potential difference between the negative (−) and positive (+) input terminals.

FIG. 13 is a circuit diagram showing another exemplary structure of the power circuit 21 described above with reference to FIG. 11. The power circuit 21 shown in FIG. 13 is different from that shown in FIG. 11 in that NMOS transistors 47 and 48 and a resistive element 49 are added between an output terminal (drain of a PMOS transistor 33) of a stepdown circuit 27 and a power source VSS.

Drain and gate electrodes of the NMOS transistor 47 and a drain electrode of the NMOS transistor 48 are connected to the output terminal of the stepdown circuit 27, a source electrode of the NMOS transistor 47 and a gate electrode of the NMOS transistor 48 are connected to one terminal of the resistive element 49, and another terminal of the resistive element 49 and a source electrode of the NMOS transistor 48 are connected to the power source VSS.

In the structure shown in FIG. 13, an output potential VDD2 of the power circuit 21 is controlled to be constant not only by a system formed by a constant voltage generation circuit 28, a differential amplifier 29 and the stepdown circuit 27 but by a system formed by the NMOS transistors 47 and 48 and the resistive element 49. The NMOS transistor 47 operates as a constant current circuit, whereby fluctuation of the output potential VDD2 of the power circuit 21 is applied to the gate electrode of the NMOS transistor 48 as potential fluctuation of a node across the NMOS transistor 47 and the resistive element 49 to increase/reduce the drain current of the NMOS transistor 48, whereby the fluctuation of the output potential VDD2 of the power circuit 21 is canceled. Consequently, the output potential VDD of the power circuit 21 shown in FIG. 13 can be further stably maintained as compared with the exemplary structure shown in FIG. 11.

The conventional power circuit having the aforementioned structure compares the constant voltage V28 of the constant voltage generation circuit 28 with the output voltage VDD2 for generating the potential for controlling the stepdown circuit 27 by the differential amplifier 29. When the output voltage VDD2 extremely fluctuates, therefore, a time is required for returning the voltage to the original potential.

With reference to the differential amplifier 29 shown in FIG. 12, potential change of the positive (+) input terminal to which the output voltage is applied appears as current change of the drain currents of the PMOS transistors 44 and 45, to change the potential of the output terminal 46.

In practice, however, the values of the drain currents of the PMOS transistors 44 and 45 are not quickly changed due to the junction capacitance of transistors in the interior of the differential amplifier 29 and mutual wiring capacitances of the transistors, and hence a time is required for changing the potential of the output terminal 46.

Thus, there is a high possibility that the potential difference between the power source VCC and the output voltage VDD2 of the power circuit is changed toward fluctuation which is reverse to that in fluctuation detection when the voltage across the power sources VCC and VSS supplied from the exterior fluctuates in a short period of about the same degree of the time required for control, i.e., when a noise of about several 10 MHz is applied across the power sources VCC and VSS and control acts from the differential amplifier 29 to the stepdown circuit 27. Therefore, the control operation of the differential amplifier 29 disadvantageously acts to amplify the potential fluctuation of the output voltage VDD2 such that the power circuit 21 cannot control the fluctuation of the output voltage VDD2 but the output voltage VDD2 enters an unsuppressible fluctuation state.

While it may be possible to solve this problem by increasing the transistor sizes in the differential amplifier 29 thereby increasing the amounts of the drain currents, this method is not practical since the amplification factor of the amplifier 29 is increased and hence the controlled variable to the stepdown circuit 27 is so excessively increased that the output voltage of the power circuit 21 may be disadvantageously oscillated.

In the power circuit 21 of the exemplary structure shown in FIG. 13, the output voltage VDD2 of the power circuit 21 can be made constant with a power source noise of a relatively high frequency. When the time required for the control from the differential amplifier 29 to the stepdown circuit 27 is identical to the period of the power source noise, however, the aforementioned unsuppressible fluctuation state is caused since current drivability of the stepdown circuit 27 is larger than that of the NMOS transistor 48, and hence fluctuation of the output voltage of the power circuit 21 cannot be suppressed.

SUMMARY OF THE INVENTION

According to a first aspect of the present invention, a voltage generation circuit comprises first and second power sources supplying first and second source voltages, constant voltage generation means generating a constant voltage which is related to the first source voltage, voltage level shift means level-shifting the first source voltage toward the second source voltage for outputting an output voltage at an output terminal on the basis of an amplified voltage, and differential amplification means comparing the output voltage with the constant voltage and amplifying the result of the comparison for outputting the amplified voltage, and the output voltage is controlled to be constant upon function of an output voltage control operation consisting of an amplification operation of the differential amplification means and a level shift operation of the voltage level shift means, the voltage generation circuit further comprises constant current supply means which is interposed between the output terminal and the second power source for supplying a constant current across the output terminal and the second power source at a current quantity based on a control voltage which is related to fluctuation in potential difference between the first and second source voltages, while the constant current which is supplied by the constant current supply means satisfies both of a condition 1) that the constant current exerts no influence on the output voltage when the output voltage control operation by the differential amplification means and the voltage level shift means is functional to enable suppression of fluctuation in the output voltage, and a condition 2) that the output voltage is level-shifted toward the second source voltage on the basis of the current quantity of the constant current when the output voltage control operation by the differential amplification means and the voltage level shift means is unfunctional to disable suppression of fluctuation in the output voltage.

According to a second aspect of the present invention, the voltage generation circuit further comprises first and second load elements which are interposed between the first and second source voltages to be connected in series with each other, and a voltage obtained from a node between the first and second load elements is provided to the constant current supply means as the control voltage.

According to a third aspect of the present invention, a voltage generation circuit comprises first and second power sources supplying first and second source voltages, constant voltage generation means generating a constant voltage which is related to the first source voltage and generating a control voltage which is related to potential difference between the first and second source voltages, voltage level shift means level-shifting the first source voltage toward the second source voltage for outputting an output voltage at an output terminal on the basis of an amplified voltage, differential amplification means comparing the output voltage with the constant voltage and amplifying the result of the comparison for outputting the amplified voltage, so that the output voltage is controlled to be constant upon function of an output voltage control operation consisting of an amplification operation of the differential amplification means and a level shift operation of the voltage level shift means, and constant current supply means which is interposed between the output terminal and the second power source for supplying a constant current across the output terminal and the second power source at a current quantity based on the control voltage, so that the output voltage is level-shifted toward the second source voltage on the basis of the current quantity of the constant current.

According to a fourth aspect of the present invention, the constant current which is supplied by the constant current supply means satisfies both of a condition 1) that the constant current exerts no influence on the output voltage when the output voltage control operation by the differential amplification means and the voltage level shift means is functional to enable suppression of fluctuation in the output voltage, and a condition 2) that the output voltage is level-shifted toward the second source voltage on the basis of the current quantity of the constant current when the output voltage control operation by the differential amplification means and the voltage level shift means is unfunctional to disable suppression of fluctuation in the output voltage.

According to a fifth aspect of the present invention, the voltage generation circuit further comprises first and second load elements which are interposed in series between the first and second source voltages so that a voltage obtained from a node between the first and second load elements serves as a second control voltage, and second constant current supply means which is interposed between the output terminal and the second power source for supplying a second constant current across the output terminal and the second power source at a current quantity based on the second control voltage.

According to a sixth aspect of the present invention, the constant current of the constant current supply means and the second constant current of the second constant current supply means satisfy both of a condition 1) that the constant current and the second constant current exert no influence on the output voltage when the output voltage control operation by the differential amplification means and the voltage level shift means is functional to enable suppression of fluctuation in the output voltage, and a condition 2) that the output voltage is level-shifted toward the second source voltage on the basis of the current quantity of the constant current and that of the second constant current when the output voltage control operation by the differential amplification means and the voltage level shift means is unfunctional to disable suppression of fluctuation in the output voltage.

According to a seventh aspect of the present invention, the voltage generation circuit further comprises a high-pass filter receiving the control voltage and removing its low-frequency component for supplying the same to the constant current supply means.

In the voltage generation circuit according to the first aspect of the present invention, the constant current which is supplied by the constant current supply means satisfies the condition 1 that the constant current exerts no influence on the output voltage when the output voltage control operation by the differential amplification means and the voltage level shift means is functional to enable suppression of fluctuation in the output voltage and the condition 2 that the output voltage is level-shifted toward the second source voltage on the basis of the current quantity of the constant current when the output voltage control operation by the differential amplification means and the voltage level shift means is unfunctional to disable suppression of fluctuation in the output voltage.

Therefore, fluctuation of the output voltage is suppressed by the output voltage control operation when the period of the fluctuation in potential difference between the first and second source voltages is relatively long and the output voltage control operation by the differential amplification means and the voltage level shift means is functional, while fluctuation of the output voltage is suppressed due to the output voltage which is level-shifted toward the second source voltage on the basis of the current quantity of the constant current when the period of fluctuation in potential difference between the first and second source voltages is relatively short and the output voltage control operation by the differential amplification means and the voltage level shift means is unfunctional.

As the result, the voltage generation circuit according to the first aspect of the present invention can regularly reliably suppress fluctuation of the output voltage regardless of the period of the fluctuation in potential difference between the first and second source voltages.

In the voltage generation circuit according to the second aspect of the present invention, the voltage obtained from the node between the first and second load elements which are interposed between the first and second power sources to be connected in series with each other serves as the control voltage of the constant current supply means.

This control voltage quickly reflects fluctuation in potential difference between the first and second source voltages, whereby fluctuation of the output voltage can be reliably suppressed by the constant current which is supplied by the constant current supply means when the output voltage control operation by the differential amplification means and the voltage level shift means is unfunctional, even if the fluctuation period of the potential difference is short.

In the voltage generation circuit according to the third aspect of the present invention, the constant current supply means supplies the constant current across the output terminal and the second power source at the current quantity based on the control voltage which is received from the constant voltage generation means.

Therefore, the voltage generation circuit according to the third aspect of the present invention can reliably suppress fluctuation of the output voltage by effectuating the output voltage control operation by the differential amplification means and the voltage level shift means or controlling the current quantity of the constant current which is supplied by the constant current supply means thereby level-shifting the output voltage toward the second source voltage.

At this time, the control voltage can be generated from the constant voltage generation means, whereby no means for generating the control voltage may be newly provided and the degree of integration as well as current consumption can be suppressed.

In the voltage generation circuit according to the fourth aspect of the present invention, the constant current which is supplied by the constant current supply means satisfies the condition 1 that the constant current exerts no influence on the output voltage when the output voltage control operation by the differential amplification means and the voltage level shift means is functional to enable suppression of fluctuation in the output voltage and the condition 2 that the output voltage is level-shifted toward the second source voltage on the basis of the current quantity of the constant current when the output voltage control operation by the differential amplification means and the voltage level shift means is unfunctional to disable suppression of fluctuation in the output voltage.

Therefore, fluctuation of the output voltage is suppressed by the output voltage control operation when the period of the fluctuation in potential difference between the first and second source voltages is relatively long and the output voltage control operation by the differential amplification means and the voltage level shift means is functional, while fluctuation of the output voltage is suppressed due to the output voltage which is level-shifted toward the second source voltage on the basis of the current quantity of the constant current when the period of fluctuation in potential difference between the first and second source voltages is relatively short and the output voltage control operation by the differential amplification means and the voltage level shift means is unfunctional.

As the result, the voltage generation circuit according to the fourth aspect of the present invention can regularly reliably suppress fluctuation of the output voltage regardless of the period of the fluctuation in potential difference between the first and second source voltages.

In the voltage generation circuit according to the fifth aspect of the present invention, the second constant current supply means is interposed between the output terminal and the second power source and supplies the second constant current across the output terminal and the second power source at the current quantity which is based on the second control voltage, while the second control voltage is a voltage obtained from the node between the first and second load elements which are interposed in series between the first and second power sources.

The second control voltage quickly reflects fluctuation in potential difference between the first and second source voltages, whereby fluctuation of the output voltage can be reliably suppressed by the constant current which is supplied by the second constant current supply means when the output voltage control operation by the differential amplification means and the voltage level shift means is unfunctional, even if the fluctuation period of the potential difference is short.

The voltage generation circuit according to the sixth aspect of the present invention satisfies the condition 1 that the constant current and the second constant current exert no influence on the output voltage when the output voltage control operation by the differential amplification means and the voltage level shift means is functional to enable suppression of fluctuation in the output voltage and the condition 2 that the output voltage is level-shifted toward the second source voltage on the basis of the current quantity of the constant current and that of the second constant current when the output voltage control operation by the differential amplification means and the voltage level shift means is unfunctional to disable suppression of fluctuation in the output voltage.

Therefore, fluctuation of the output voltage is suppressed by the output voltage control operation when the period of the fluctuation in potential difference between the first and second source voltages is relatively long and the output voltage control operation by the differential amplification means and the voltage level shift means is functional, while fluctuation of the output voltage is suppressed due to the output voltage which is level-shifted toward the second source voltage on the basis of the current quantity of the constant current and that of the second constant current when the period of fluctuation in potential difference between the first and second source voltages is relatively short and the output voltage control operation by the differential amplification means and the voltage level shift means is unfunctional.

As the result, the voltage generation circuit according to the sixth aspect of the present invention can regularly reliably suppress fluctuation of the output voltage regardless of the period of the fluctuation in potential difference between the first and second source voltages.

In the voltage generation circuit according to the seventh aspect of the present invention, the high-pass filter removes the low-frequency component from the control voltage and supplies the same to the constant current supply means, whereby the constant current of the constant current supply means can be made constant to exert no influence on the output voltage when the period of fluctuation in potential difference between the first and second source voltages is in a relatively long low frequency region and the output voltage control operation by the differential amplification means and the voltage level shift means is functional.

As the result, the amount of current change of the constant current of the constant current supply means can be set to be suitable only when the period of fluctuation in potential difference between the first and second source voltages is in a relatively short high frequency region, whereby an effect of suppressing voltage fluctuation can be further effectuated with respect to the high frequency region of the fluctuation in potential difference between the first and second source voltages.

An object of the present invention is to obtain a voltage generation circuit such as a power circuit, which can reliably suppress fluctuation of an output voltage regardless of the frequency of source voltage fluctuation.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

<Embodiment 1>

Figure 1:
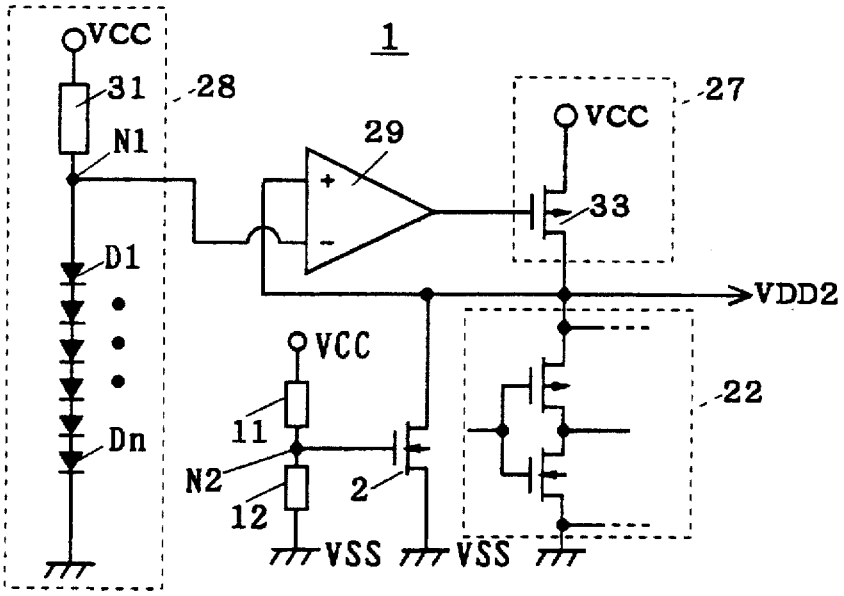
FIG. 1 is a circuit diagram showing the structure of a power circuit according to an embodiment 1 of the present invention.

FIG. 1 is a block diagram showing the structure of a power circuit according to an embodiment 1 of the present invention.

Figure 11:
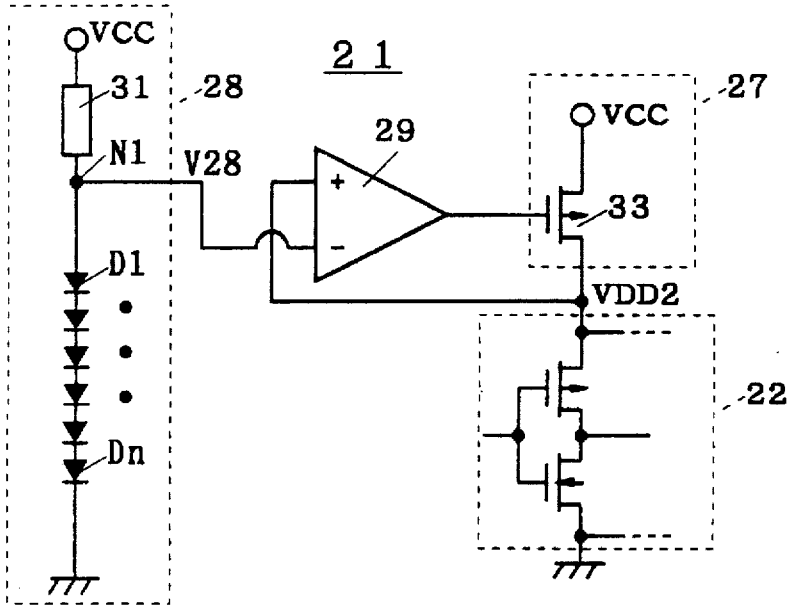
FIG. 11 is a circuit diagram showing the structure of the conventional power circuit.
Figure 12:
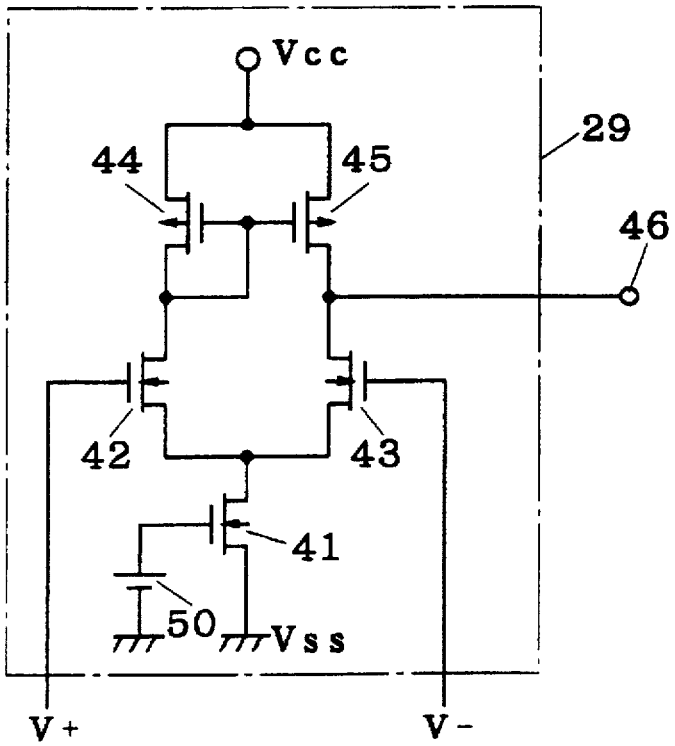
FIG. 12 is a circuit diagram showing an exemplary internal structure of a differential amplification circuit appearing in FIG. 11.

As shown in FIG. 1, load elements 11 and 12 are connected in series between power sources VCC and VSS. An NMOS transistor 2 serving as constant current supply means has a source electrode, a drain electrode and a gate electrode which are connected to the power source VSS, an output terminal of a stepdown circuit 27 (drain of a PMOS transistor 33), and a node N2 between the load elements 11 and 12 respectively. The remaining structure is identical to that of the conventional power circuit 21 shown in FIG. 11, and hence redundant description is omitted.

The node N2 between the load elements 11 and 12 of the power circuit 1 has a function of remarkably reducing an output voltage VDD2 of the power circuit 1 when the voltage across the power sources VCC and VSS is increased while slightly reducing the output voltage VDD2 of the power circuit 1 when potential difference between the power sources VCC and VSS is reduced by the drain current of the NMOS transistor 2 since a control voltage which reflects voltage fluctuation across the power sources VCC and VSS is applied to the gate electrode of the NMOS transistor 2. The transistor size of the NMOS transistor 2 is set to satisfy the following conditions 1 and 2:

Condition 1) The drain current of the NMOS transistor 2 exerts no influence on fluctuation of the output voltage VDD2 when an output voltage control operation consisting of an amplification operation of a differential amplifier 29 and a stepdown operation of the stepdown circuit 27 is functional to enable suppression of fluctuation in the output voltage VDD2.

Condition 2) The output voltage VDD2 is stepped down (level-shifted toward the source voltage VSS) on the basis of the current quantity of the drain current of the NMOS transistor 2 when the aforementioned output voltage control operation is unfunctional to disable suppression of fluctuation of the output voltage VDD2.

When the period of fluctuation of the potential difference between the power sources VCC and VSS is longer than the control time for the stepdown circuit 27 by the differential amplifier 29 in this structure, the output voltage control operation by the differential amplifier 29 and the stepdown circuit 27 strongly functions to reliably suppress fluctuation of the output voltage VDD2 since the transistor size of the NMOS transistor 2 satisfies the condition 1.

When the period of fluctuation of the potential difference between the power sources VCC and VSS approaches the control time of the stepdown circuit 27 by the differential amplifier 29 and the output voltage control operation by the differential amplifier 29 and the stepdown circuit 27 is unfunctional to disable suppression of fluctuation in the output voltage VDD2 of the power circuit 1, on the other hand, the stepdown quantity of the output voltage VDD2 is controlled on the basis of the current quantity of the drain current of the NMOS transistor 2 so that fluctuation of the output voltage VDD2 of the power circuit 1 is reliably suppressed since the transistor size of the NMOS transistor 2 satisfies the condition 2.

Further, the control voltage obtained from the node N2 between the load elements 11 and 12 is applied to the gate electrode of the NMOS transistor 2 serving as constant current supply means. This control voltage quickly reflects fluctuation of the potential difference between the source voltages of the power sources VCC and VSS, whereby fluctuation of the output voltage VDD2 can be reliably suppressed by the drain current of the NMOS transistor 2 when the output voltage control operation by the differential amplifier 29 and the stepdown circuit 27 is unfunctional even if the fluctuation period of the potential difference is short.

Figure 2:
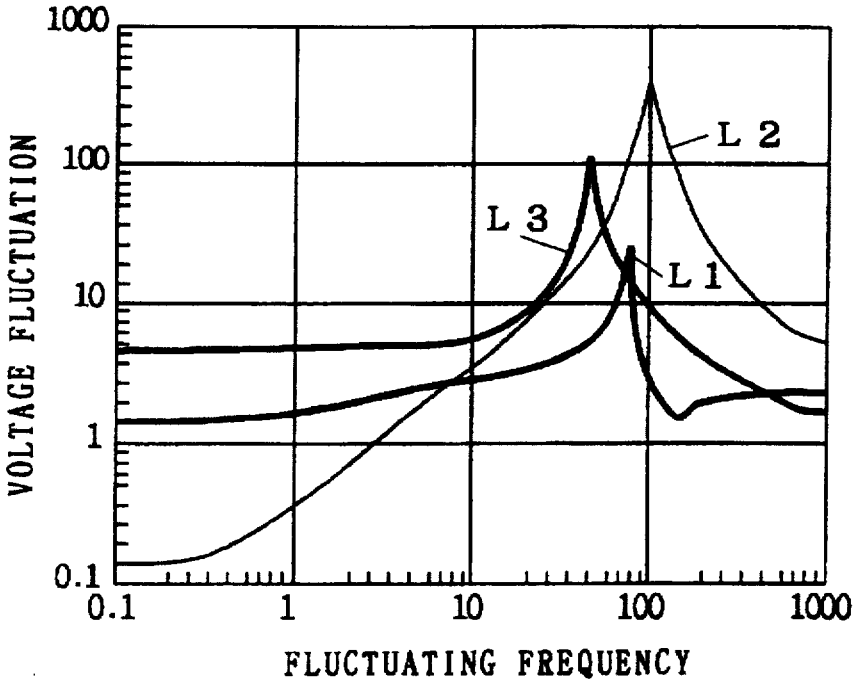
FIG. 2 is a graph showing a voltage fluctuation effect of the embodiment 1.

FIG. 2 illustrates voltage fluctuation values of the output voltage VDD2 of the power circuit 1 at various frequencies of voltage fluctuation between the power sources VCC and VSS. Referring to FIG. 2, curves L1, L2 and L3 show voltage fluctuation in the power circuit 1 of the structure shown in FIG. 1 with the PMOS transistor 33 and the NMOS transistor 2 at a transistor size ratio of 5:4, that in the power circuit 1 of the structure shown in FIG. 1 with the PMOS transistor 33 and the NMOS transistor 2 at a transistor size ratio of 11:10, and that in the conventional power circuit 21 respectively.

It is understood from FIG. 2 that both of the conditions 1 and 2 are satisfied to attain the effect of suppressing the output voltage VDD2 at the maximum when the PMOS transistor 33 and the NMOS transistor 2 are at the transistor size ratio of 5:4.

Thus, the NMOS transistor 2 whose transistor size is 4/5 that of the PMOS transistor 33 of the stepdown circuit 27 is provided to satisfy the conditions 1 and 2 in the power circuit 1 according to the embodiment 1. Further, the control voltage quickly reflecting the fluctuation of the potential difference between the power sources VCC and VSS is supplied from the node N2 between the load elements 11 and 12 to the gate electrode of the NMOS transistor 2.

Consequently, the output voltage VDD2 of the power circuit 1 maintains stability similarly to the conventional power circuit 21 when the fluctuation of the potential difference between the power sources VCC and VSS is in a low frequency region, while the fluctuation of the output voltage VDD2 can be suppressed by the drain current of the NMOS transistor 2 when the output voltage fluctuation of the power circuit 1 is at its peak.

While Japanese Patent Laying-Open Gazette No. 59-110225 (1984) discloses stepdown circuits (corresponding to the stepdown circuit 27 shown in FIG. 11) which are formed by an NMOS transistor, an NPN bipolar transistor and a PNP bipolar transistor in addition to that formed by a PMOS transistor, this also applies to the present invention. Namely, the stepdown circuit 27 of the power circuit 1 may alternatively be formed by an NMOS transistor to be combined with the load elements 11 and 12 and the NMOS transistor 2, or the same may be formed by an NPN bipolar transistor or a PNP bipolar transistor to be combined with the load elements 11 and 12 and the NMOS transistor 2, to attain an effect similar to the above.

<Embodiment 2>

Figure 3:
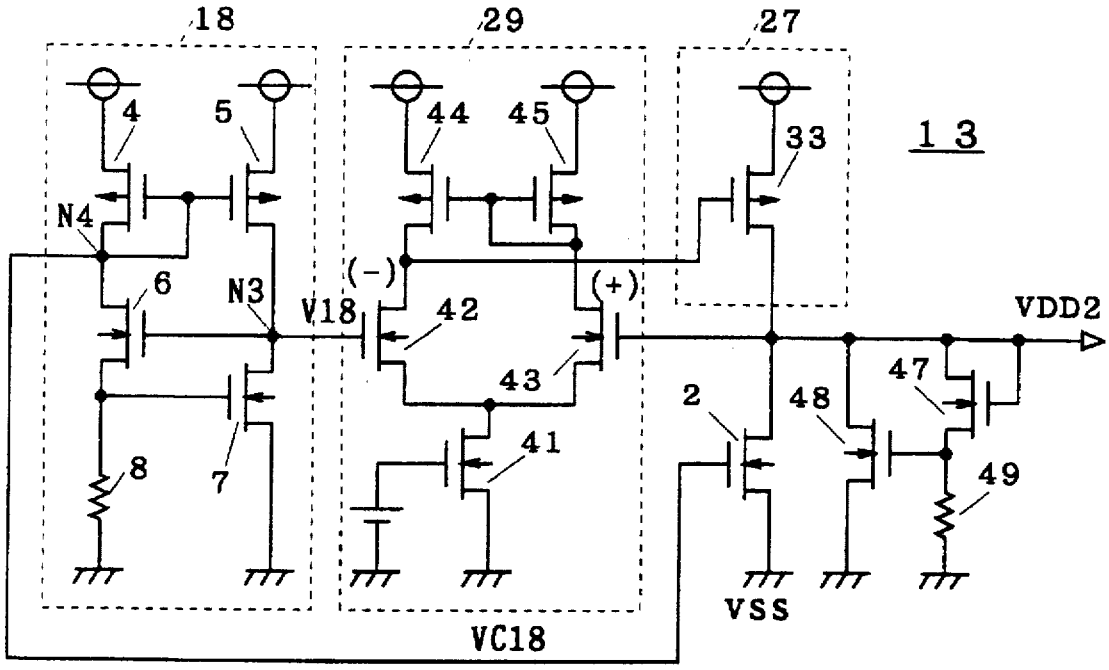
FIG. 3 is a circuit diagram showing the structure of a power circuit according to an embodiment 2 of the present invention.
Figure 13:
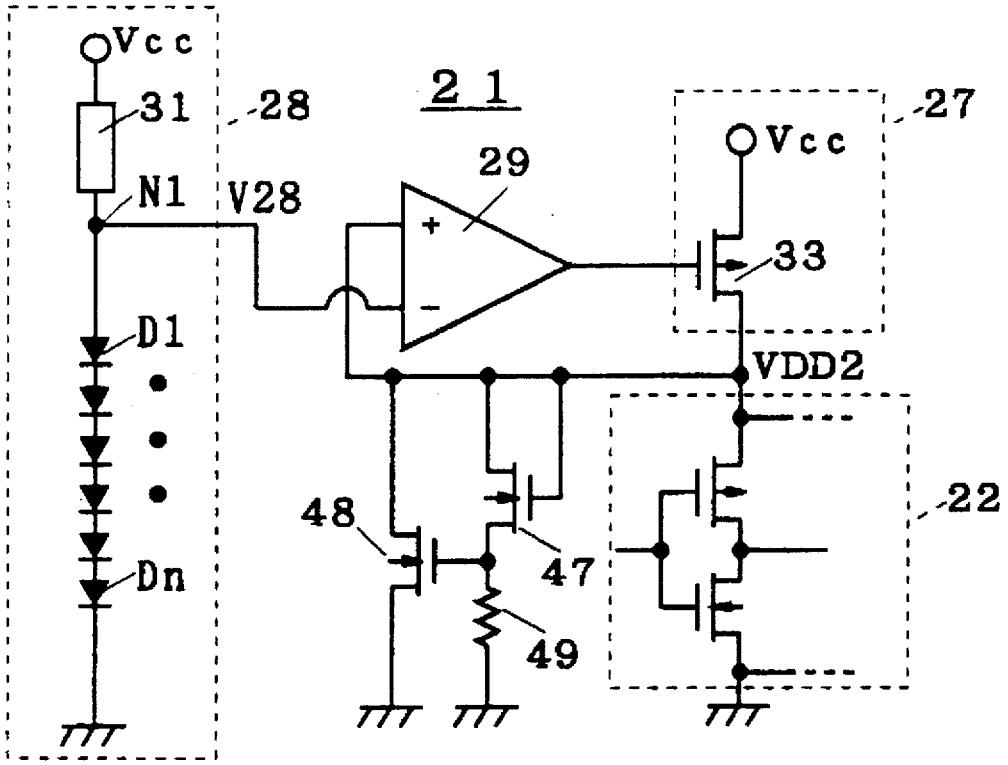
FIG. 13 is a circuit diagram showing another exemplary structure of the power circuit shown in FIG. 11.

FIG. 3 is a circuit diagram showing the structure of a power circuit 13 according to an embodiment 2 of the present invention. As shown in FIG. 3, a constant voltage generation circuit 18 is formed by the so-called threshold referenced bias circuit consisting of MOS transistors and a resistance, so that a gate potential of an NMOS transistor 2 which is inserted between an output terminal of a stepdown circuit 27 and a power source VSS is obtained from the constant voltage generation circuit 18. Further, NMOS transistors 47 and 48 and a resistive element 49 corresponding to those described with reference to the prior art shown in FIG. 13 are added between the output terminal of the stepdown circuit 27 and the power source VSS. A PMOS transistor 33 of the stepdown circuit 27 and the NMOS transistors 2 and 48 are at transistor size ratios of 4:1:1. The conditions 1 and 2 described with reference to the embodiment 1 can be satisfied by such transistor size ratios.

Referring to FIG. 3, the NMOS transistor 2 serving as constant current supply means has a source electrode and a drain electrode which are connected to the power source VSS and the output terminal of the stepdown circuit 27 respectively. Drain and gate electrodes of the NMOS transistor 47 and a drain electrode of the NMOS transistor 48 are connected to the output terminal of the stepdown circuit 27, a source electrode of the NMOS transistor 47 and a gate electrode of the NMOS transistor 48 are connected to one terminal of the resistive element 49, and the other terminal of the resistive element 49 and a source electrode of the NMOS transistor 48 are connected to the power source VSS.

The constant voltage generation circuit 18 is formed by PMOS transistors 4 and 5, NMOS transistors 6 and 7 and a resistance 8. Source electrodes of the PMOS transistors 4 and 5 are connected to a power source VCC, gate electrodes thereof are connected to drain electrodes of the PMOS transistor 4 and the NMOS transistor 6, a drain electrode of the PMOS transistor 5 is connected to a drain electrode of the NMOS transistor 7 and a gate electrode of the NMOS transistor 6, a source electrode of the NMOS transistor 6 and a gate electrode of the NMOS transistor 7 are connected to an end of the resistance 8, and the other end of the resistance 8 and a source electrode of the NMOS transistor 7 are connected to the power source VSS, thereby forming a threshold referenced bias circuit.

A voltage which is obtained from a node N3 between the drain electrodes of the PMOS transistor 5 and the NMOS transistor 7 and the gate electrode of the NMOS transistor 6 is applied to a negative (−) input terminal of a differential amplifier 29 as a constant voltage V18, while a voltage obtained from a node N4 between the drain and gate electrodes of the PMOS transistor 4, the gate electrode of the PMOS transistor 5 and the drain electrode of the NMOS transistor 6 is applied to the gate electrode of the NMOS transistor 2 as a control voltage VC18. Other portions of this embodiment are similar to those of the power circuit 21 shown in FIG. 13, and hence redundant description is omitted.

In the constant voltage generation circuit 18 serving as a threshold referenced bias circuit, the PMOS transistors 4 and 5 form a current mirror circuit, whereby a current which is identical to that flowing through the resistance 8 and across the source and the drain of the NMOS transistor 6 also flows across the source and drain of the NMOS transistor 7.

Also upon fluctuation in potential difference between the power sources VCC and VSS, therefore, potential difference across the resistance 8 is increased to reduce source-to-drain impedance of the NMOS transistor 7 when the current flowing through the NMOS transistor 6 is increased, whereby the drain voltage of the NMOS transistor 7 is reduced to reduce the current flowing through the NMOS transistor 6. When the current flowing through the NMOS transistor 6 is reduced, on the other hand, the potential difference across the resistance 8 is reduced to increase the source-to-drain impedance of the NMOS transistor 7, whereby the drain voltage of the NMOS transistor 7 is increased to increase the current flowing through the NMOS transistor 6 and hence feedback is applied.

Consequently, the constant voltage V18 outputted from the node N3 of the constant voltage generation circuit 18 is at a constant voltage value regardless of voltage fluctuation between the power sources VCC and VSS. On the other hand, the control voltage VC18 which is outputted from the node N4 of the constant voltage generation circuit 18 reflects the voltage fluctuation between the power sources VCC and VSS as such.

Further, the time required for attaining feedback in the threshold referenced bias circuit is sufficiently shorter than that required for controlling the stepdown circuit 27 by the differential amplifier 29, whereby the control voltage VC18 quickly reflects the voltage fluctuation between the power sources VCC and VSS even if this fluctuation is at a high frequency.

In the power circuit 13 according to the embodiment 2, therefore, the transistor sizes of the NMOS transistors 2 and 48 are set to satisfy the aforementioned conditions 1 and 2, whereby fluctuation of an output voltage VDD2 can be suppressed due to change of the drain current of the NMOS transistor 2 when an output voltage control operation by the differential amplifier 29 and the stepdown circuit 27 is unfunctional to disable suppression of fluctuation of the output voltage VDD2, similarly to the power circuit 1 according to the embodiment 1.

Further, the power circuit 13 according to the embodiment 2 requires no load elements 11 and 12 which are inserted between the power sources VCC and VSS dissimilarly to the power circuit 1 according to the embodiment 1, whereby fluctuation in the output voltage VDD2 of the power circuit 13 can advantageously be suppressed without increasing the degree of integration and current consumption when the constant voltage generation circuit 13 is formed by a threshold referenced bias circuit.

Figure 4:
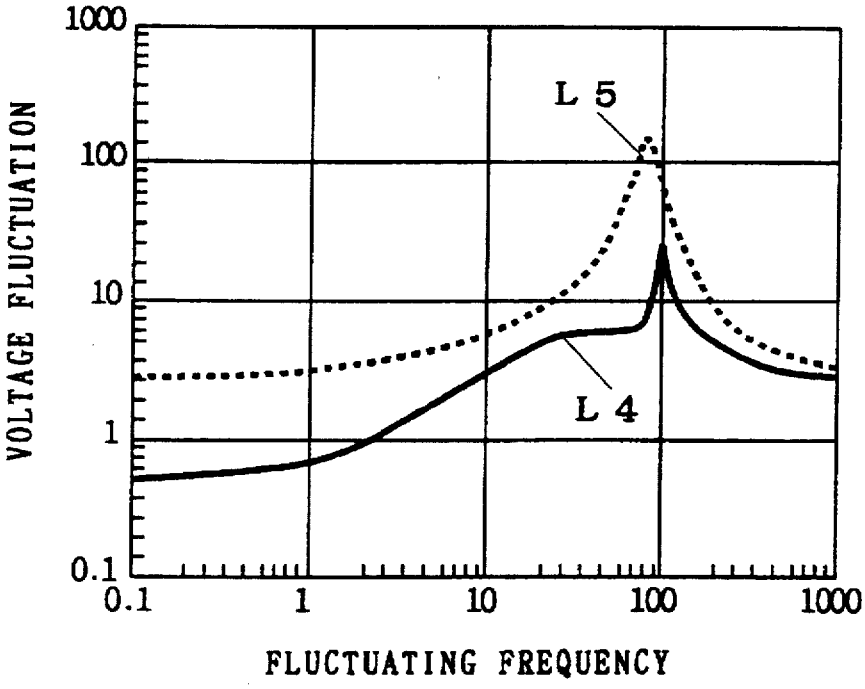
FIG. 4 is a graph showing a voltage fluctuation effect of the embodiment 2.

FIG. 4 illustrates voltage fluctuation values of the output voltage VDD2 of the power circuit at various frequencies of voltage fluctuation between the power sources VCC and VSS. Referring to FIG. 4, curves LA and L5 show voltage fluctuation in the power circuit 13 of the structure shown in FIG. 3 with the PMOS transistor 33 and the NMOS transistors 2 and 48 at transistor size ratios of 4:1:1, and that in the conventional power circuit 21 respectively.

It is understood from FIG. 4 that the power circuit 13 according to the embodiment 2 having the structure shown in FIG. 3 can sufficiently attain the effect of suppressing the output voltage VDD2 as compared with the prior art.

In the power circuit 13 according to the embodiment 2, the circuit which is formed by the NMOS transistors 47 and 49 and the resistive element 49 is employed in order to further stabilize the output voltage VDD2 of the power circuit 13. Therefore, the aforementioned effect can be attained regardless of the NMOS transistors 47 and 48 and the resistive element 49.

Also in the power circuit 13 according to the embodiment 2, the stepdown circuit 27 may alternatively be formed by an NMOS transistor, an NPN bipolar transistor or a PNP bipolar transistor, to be combined with the NMOS transistor 2 and a threshold referenced bias circuit to attain an effect similar to the above, similarly to the power circuit 1 according to the embodiment 1.

While the constant voltage generation circuit 18 is formed by a threshold referenced bias circuit in the power circuit 13 according to the embodiment 2, the same may alternatively be formed by a VBE referenced bias circuit or a thermal voltage referenced current source circuit. In this *case, the control voltage VC18 which is applied to the gate electrode of the NMOS transistor 2 must be taken from a potential point developing voltage fluctuation which is in phase with that between the power sources VCC and VSS in the constant voltage generation circuit.

Figure 5:
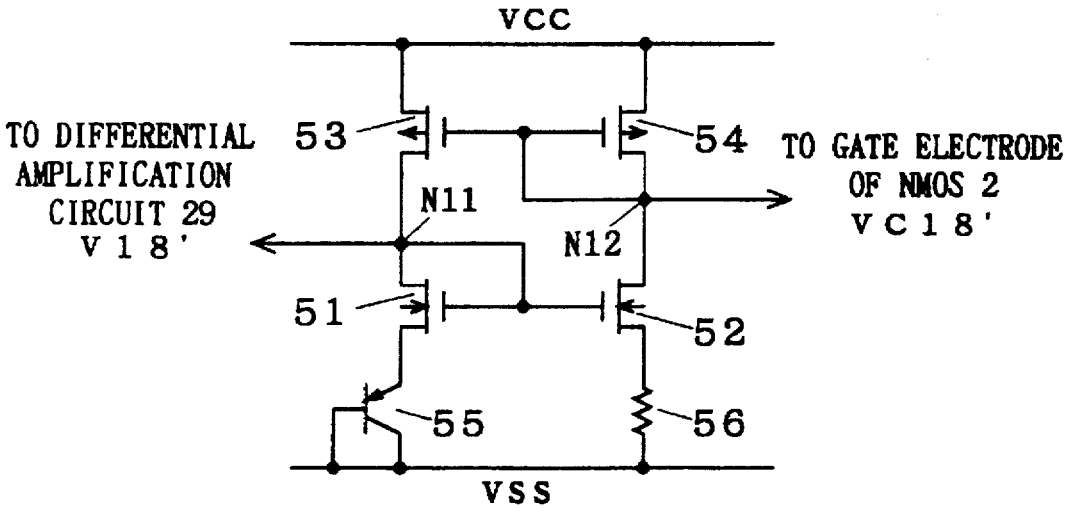
FIG. 5 is a circuit diagram partially showing another structure of the power circuit according to the embodiment 2 of the present invention.

FIG. 5 illustrates an exemplary referenced bias circuit. As shown in FIG. 5, both source electrodes of PMOS transistors 53 and 54 are connected to a power source VCC, while a gate electrode of the PMOS transistor 54 is connected to drain electrodes of the PMOS transistor 54 and an NMOS transistor 52. A source electrode of the NMOS transistor 52 is connected to a power source VSS through a resistive element 56, while its gate electrode is connected to drain and gate electrodes of an NMOS transistor 51 and a drain electrode of the PMOS transistor 53. An emitter electrode of a PNP bipolar transistor 55 is connected to a source electrode of the NMOS transistor 51, while its collector and base electrodes are connected to the power source VSS.

In such a structure, a constant voltage V18' which is obtained from a node N11 between the drain electrodes of the PMOS transistor 53 and the NMOS transistor 51 is applied to a differential amplifier 29, while a control voltage VC18' which is obtained from a node N12 between the drain electrodes of the PMOS transistor 54 and the NMOS transistor 52 is applied to a gate electrode of an NMOS transistor 2.

Figure 6:
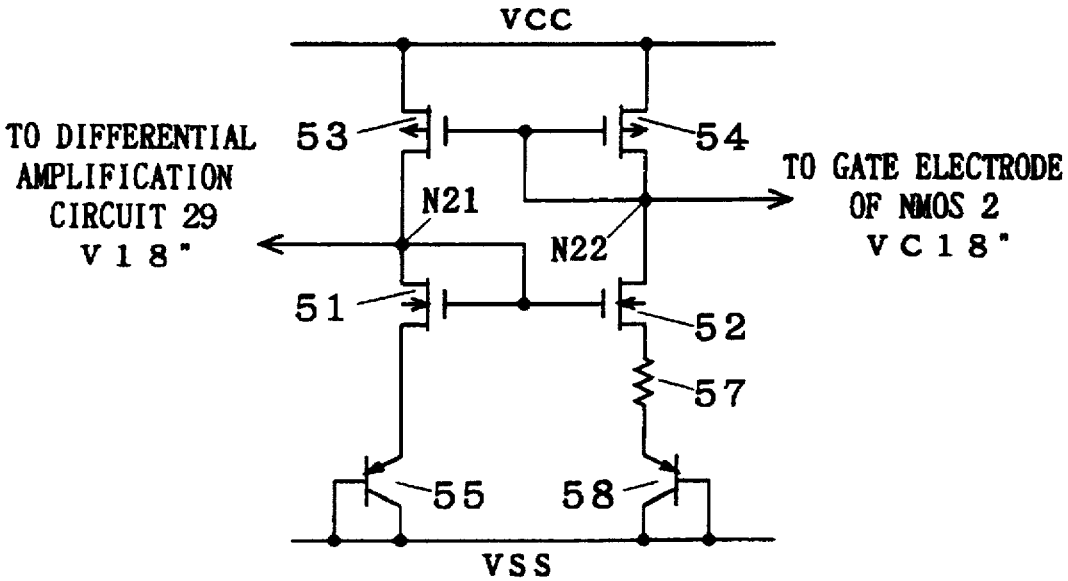
FIG. 6 is a circuit diagram partially showing still another structure of the power circuit according to the embodiment 2 of the present invention.

FIG. 6 is a circuit diagram showing an exemplary thermal voltage referenced current source circuit. As shown in FIG. 6, both source electrodes of PMOS transistors 53 and 54 are connected to a power source VCC, and a gate electrode of the PMOS transistor 54 is connected to drain electrodes of the PMOS transistor 54 and an NMOS transistor 52. A source electrode of the NMOS transistor 52 is connected to an emitter electrode of a PNP bipolar transistor 58 through a resistive element 57, while its gate electrode is connected to drain and gate electrodes of an NMOS transistor 51 and a drain electrode of the PMOS transistor 53. Further, an emitter electrode of a PNP bipolar transistor 55 is connected to a source electrode of the NMOS transistor 51, while its collector and base electrodes are connected to a power source VSS. Collector and base electrodes of the PNP bipolar transistor 58 are connected to the power source VSS.

In such a structure, a constant voltage V18' which is obtained from a node N21 between the drain electrodes of the PMOS transistor 53 and the NMOS transistor 51 is applied to a differential amplifier 29, while a control voltage VC18' which is obtained from a node N22 between the drain electrodes of the PMOS transistor 54 and the NMOS transistor 52 is applied to a gate electrode of an NMOS transistor 2.

<Embodiment 3>

Figure 7:
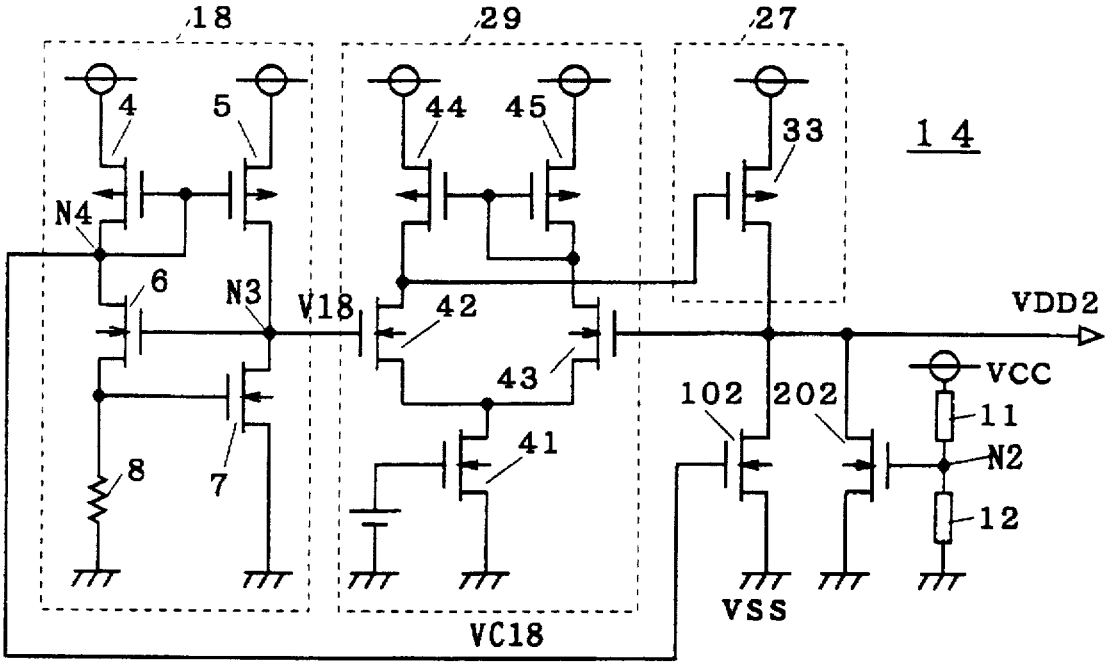
FIG. 7 is a circuit diagram showing the structure of a power circuit according to an embodiment 3 of the present invention.

FIG. 7 is a circuit diagram showing the structure of a power circuit 14 according to an embodiment 3 of the present invention. As shown in FIG. 7, both of NMOS transistors 102 and 202 are employed as constant current circuits in the power circuit 14 according to the embodiment 3. Namely, the NMOS transistors 102 and 202 serving as constant current supply means are interposed between an output of a stepdown circuit 27 (drain of a PMOS transistor 33) and a power source VSS. A gate electrode of the NMOS transistor 102 receives a control voltage VC18 from a constant voltage generation circuit 18, while that of the NMOS transistor 202 is connected to a node N2 between load elements 11 and 12 which are connected in series between power sources VCC and VSS.

The PMOS transistor 33 and the NMOS transistors 101 and 202 are at transistor size ratios of 5:2:2. The conditions 1 and 2 described with reference to the embodiment 1 can be satisfied by such transistor size ratios.

In the power circuit 14 according to the embodiment 3, the potential of the node N2 between the load elements 11 and 12 fluctuates substantially in phase with that of potential difference between the power sources VCC and VSS, while the control voltage VC18 which is supplied to the gate electrode of the NMOS transistor 102 in the constant voltage generation circuit 18 fluctuates at a slight phase lag from the voltage fluctuation across the power sources VCC and VSS due to a feedback circuit existing in the constant voltage generation circuit 18. Thus, the two NMOS transistors 102 and 202 act on an output voltage VDD2 of the power circuit 14 in an out-of-phase manner, whereby an effect of suppressing output voltage fluctuation can be attained in a low frequency region of the source voltage fluctuation.

Figure 8:
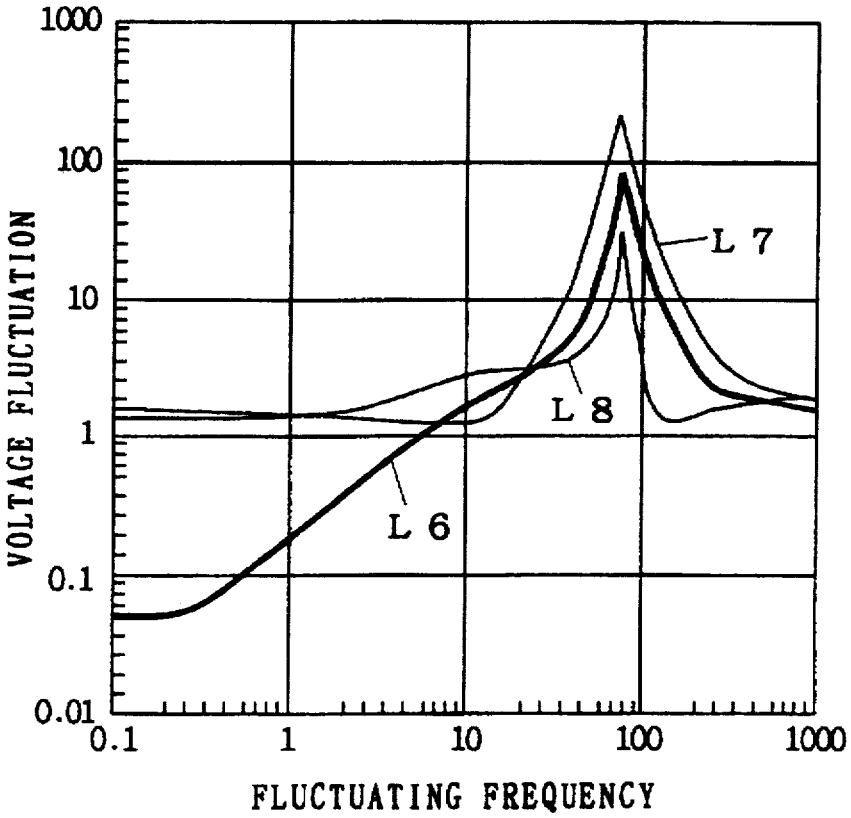
FIG. 8 is a graph showing a voltage fluctuation effect of the embodiment 3.

FIG. 8 illustrates voltage fluctuation values of the output voltage VDD2 of the power circuit at various frequencies of voltage fluctuation between the power sources VCC and VSS. Referring to FIG. 2, curves L6, L7 and L8 show voltage fluctuation in the power circuit 14 according to the embodiment 3, that with only the NMOS transistor 102 (the transistor size ratio of the PMOS transistor 33 to the NMOS transistor 102 is 5:4), and that with only the NMOS transistor 202 (the transistor size ratio of the PMOS transistor 33 to the NMOS transistor 202 is 5:4) respectively.

It is understood from FIG. 8 that an effect of suppressing fluctuation of the output voltage VDD2 appearing on the curve L6 can be attained at the maximum in the power circuit 14 according to the embodiment 3 in a low frequency region as compared with the remaining curves L7 and L8.

Thus, the power circuit 14 according to the embodiment 3 can effectively suppress fluctuation of the output voltage VDD2 particularly when the voltage fluctuation is in a low frequency region, by forming the constant current circuit by a combination of the NMOS transistors 102 and 202.

<Embodiment 4>

Figure 9:
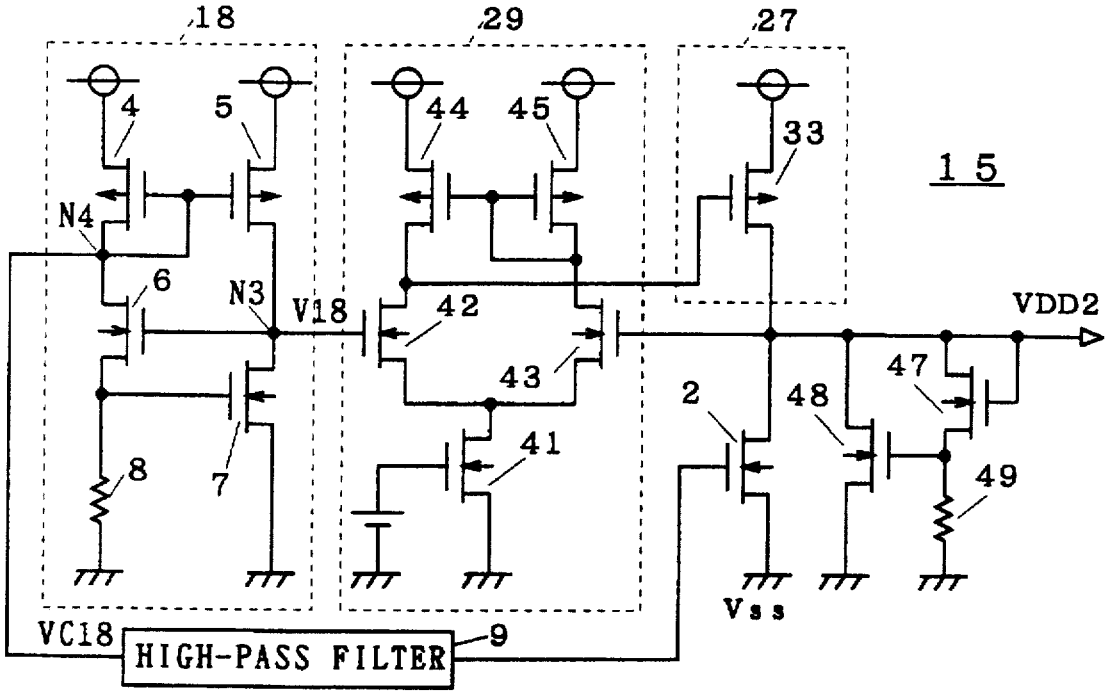
FIG. 9 is a circuit diagram showing the structure of a power circuit according to an embodiment 4 of the present invention.
Figure 10:
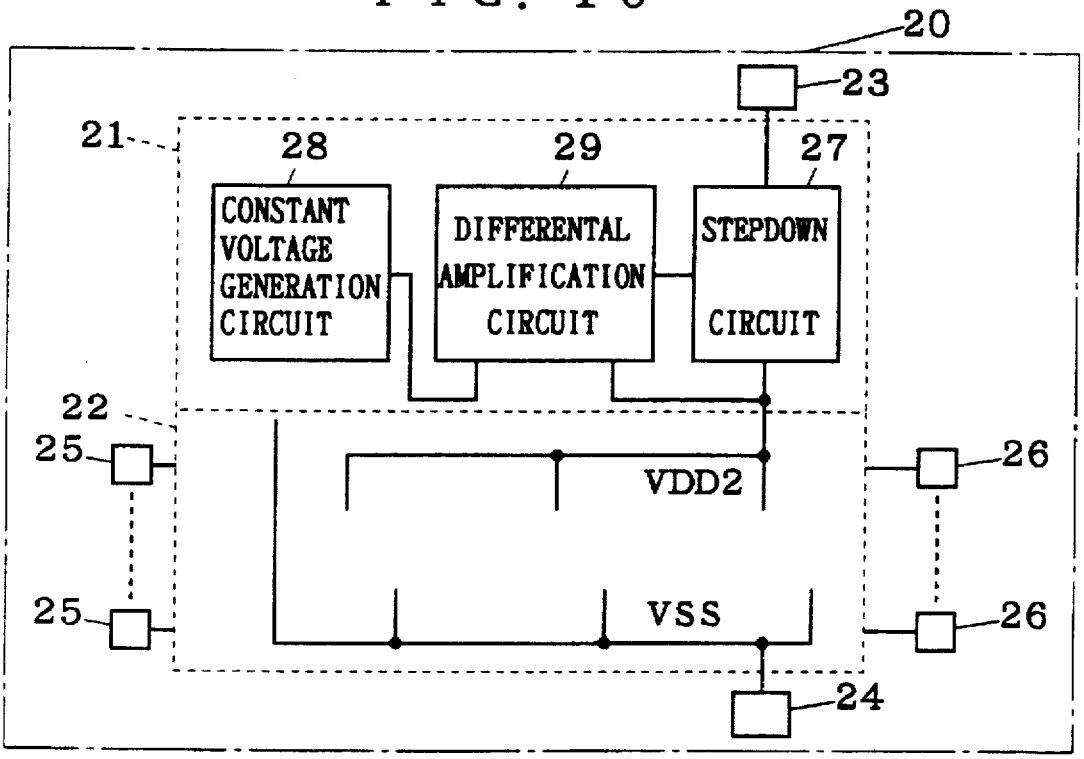
FIG. 10 is an explanatory diagram showing the structure of a conventional semiconductor integrated circuit having a power circuit.

FIG. 9 is a circuit diagram showing the structure of a power circuit 15 according to an embodiment 4 of the present invention. As shown in FIG. 9, a control voltage VC18 of a constant voltage generation circuit 18 is supplied to a gate electrode of an NMOS transistor 2 through a high-pass filter 9. The high-pass filter 9 performs filtering of passing only a frequency which is higher than a predetermined one on the control voltage VC18. The remaining structure is similar to that of the power circuit 13 according to the embodiment 2 shown in FIG. 3.

In the power circuit 15 according to the embodiment 4, the frequency at which the high-pass filter 9 starts to pass the control voltage VC18 is set at a frequency at which increase in fluctuation of an output voltage of the power circuit 15 is started, whereby output fluctuation of the power circuit 15 can be made identical to that in the prior art when voltage fluctuation between power sources VCC and VSS is at a low frequency, while only output voltage fluctuation which is at the peak due to high frequency voltage fluctuation between the power sources VCC and VSS can be suppressed.

Further, the NMOS transistor 2 (the NMOS transistor 102 in the embodiment 3) is unfunctional when fluctuation in potential difference between the power sources VCC and VSS is in a low frequency region in the power circuit 15 according to the embodiment 4 dissimilarly to the power circuits 13 and 14 according to the embodiments 2 and 3, whereby a current change quantity of the NMOS transistor 2 can be increased.

In addition to the effect of the embodiment 2, therefore, it is possible to also attain an effect of strengthening suppression of peak output voltage fluctuation of the power circuit 15 by increasing the transistor size of the NMOS transistor 2.

While the invention has been shown and described in detail, the foregoing description is in all aspects illustrative and not restrictive. It is therefore understood that numerous modifications and variations can be devised without departing from the scope of the invention.

What is claimed is:

1. A voltage generation circuit comprising:

first and second power sources supplying first and second source voltages;

constant voltage generation means generating a constant voltage between said first and second source voltages;

voltage level shift means level-shifting said first source voltage toward said second source voltage for outputting an output voltage at an output terminal on the basis of an amplified voltage;

differential amplification means comparing said output voltage with said constant voltage and amplifying the result of said comparison for outputting said amplified voltage, said output voltage being controlled to be constant upon function of an output voltage control operation consisting of an amplification operation of said differential amplification means and a level shift operation of said voltage level shift means; and constant current supply means being coupled between said output terminal and said second power source for supplying a constant current across said output terminal and said second power source at a current quantity being based on a control voltage being related to fluctuation in potential difference between said first and second source voltages, said constant current being supplied by said constant current supply means satisfying both of the following conditions 1 and 2:

condition 1) said constant current exerts no influence on said output voltage when said output voltage control operation by said differential amplification means and said voltage level shift means is functional to enable suppression of fluctuation in said output voltage; and condition 2) said output voltage is level-shifted toward said second source voltage on the basis of the current quantity of said constant current when said output voltage control operation by said differential amplification means and said voltage level shift means is unfunctional to disable suppression of fluctuation in said output voltage.

2. The voltage generation circuit in accordance with claim 1, further comprising:

first and second load elements being coupled between said first and second source voltages to be connected in series with each other, a voltage obtained from a node between said first and second load elements being provided to said constant current supply means as said control voltage.

3. The voltage generation circuit in accordance with claim 2, wherein said voltage level shift means includes a first conductivity type first transistor having a control electrode receiving said amplified voltage, a first electrode being connected to said first power source, and a second electrode serving as said output terminal, and said constant current supply means includes a second conductivity type second transistor having a control electrode receiving said control voltage, a first electrode being connected to said second power source, and a second electrode being connected to said output terminal.

4. A voltage generation circuit comprising:

first and second power sources supplying first and second source voltages;

constant voltage generation means generating a constant voltage between said first and second source voltages and generating a control voltage being related to potential difference between said first and second source voltages;

voltage level shift means level-shifting said first source voltage toward said second source voltage for outputting an output voltage at an output terminal on the basis of an amplified voltage;

differential amplification means comparing said output voltage with said constant voltage and amplifying the result of said comparison for outputting said amplified voltage, said output voltage being controlled to be constant upon function of an output voltage control operation consisting of an amplification operation of said differential amplification means and a level shift operation of said voltage level shift means; and constant current supply means being coupled between said output terminal and said second power source for supplying a constant current across said output terminal and said second power source at a current quantity being based on said control voltage, said output voltage being level-shifted toward said second source voltage on the basis of the current quantity of said constant current.

5. The voltage generation circuit in accordance with claim 4, wherein said constant current being supplied by said constant current supply means satisfies both of the following conditions 1 and 2:

condition 1) said constant current exerts no influence on said output voltage when said output voltage control operation by said differential amplification means and said voltage level shift means is functional to enable suppression of fluctuation in said output voltage; and condition 2) said output voltage is level-shifted toward said second source voltage on the basis of the current quantity of said constant current when said output voltage control operation by said differential amplification means and said voltage level shift means is unfunctional to disable suppression of fluctuation in said output voltage.

6. The voltage generation circuit in accordance with claim 5, wherein said voltage level shift means includes a first conductivity type first transistor having a control electrode receiving said amplified voltage, a first electrode being connected to said first power source, and a second electrode serving as said output terminal, and said constant current supply means includes a second conductivity type second transistor having a control electrode directly receiving said control voltage, a first electrode being connected to said second power source, and a second electrode being connected to said output terminal.

7. The voltage generation circuit in accordance with claim 6, wherein said constant voltage generation means comprises:

a first conductivity type third transistor having a first electrode being connected to said first power source, and a second electrode and a control electrode being short-circuited at a first node, a first conductivity type fourth transistor having a first electrode being connected to said first power source, a control electrode being connected to said first node, and a second electrode being connected to a second node, a resistive element having an end being connected to said second power source, a second conductivity type fifth transistor having a first electrode being connected to another end of said resistive element, a second electrode being connected to said first node, and a control electrode being connected to said second node, and a second conductivity type sixth transistor having a first electrode being connected to said second power source, a second electrode being connected to said second node, and a control electrode being connected to another end of said resistive element and said first electrode of said fifth transistor, a voltage being obtained from said first node is said control voltage, and a voltage being obtained from said second node is said constant voltage.

8. The voltage generation circuit in accordance with claim 7, further comprising:

a second resistive element having an end being connected to said second power source, a seventh transistor having a first electrode being connected to another end of said second resistive element, and a second electrode and a control electrode being connected to said output terminal, and an eighth transistor having a first electrode being connected to said second power source, a second electrode being connected to said output terminal, and a control electrode being connected to another end of said second resistive element and said first electrode of said seventh transistor.

9. The voltage generation circuit in accordance with claim 8, wherein transistor sizes of said first, second and eighth transistors are in the ratios of 5:2:2.

10. The voltage generation circuit in accordance with claim 9, wherein said first source voltage is higher than said second source voltage, and said first and second conductivity types are P and N types respectively.

11. The voltage generation circuit in accordance with claim 6, wherein said constant voltage generation means comprises:

a first conductivity type third transistor having a first electrode being connected to said first power source, and a second electrode and a control electrode being short-circuited at a first node, a first conductivity type fourth transistor having a first electrode being connected to said first power source, a control electrode being connected to said first node, and a second electrode being connected to a second node, a resistive element having an end being connected to said second power source, a second conductivity type fifth transistor having a first electrode being connected to another end of said resistive element, a second electrode being connected to said first node, and a control electrode being connected to said second node, a second conductivity type sixth transistor having a second electrode and a control electrode being short-circuited at said second node, and a first conductivity type seventh transistor having a first electrode being connected to a first electrode of said sixth transistor, and a control electrode and a second electrode being connected to said second power source, a voltage being obtained from said first node is said control voltage, and a voltage being obtained from said second node is said constant voltage.

12. The voltage generation circuit in accordance with claim 6, wherein said constant voltage generation means comprises:

a first conductivity type third transistor having a first electrode being connected to said first power source, and a second electrode and a control electrode being short-circuited at said first node, a first conductivity type fourth transistor having a first electrode being connected to said first power source, a control electrode being connected to said first node, and a second electrode being connected to a second node, a second conductivity type fifth transistor having a second electrode being connected to said first node, and a control electrode being connected to said second node, a second conductivity type sixth transistor having a second electrode and a control electrode being short-circuited at said second node, a first conductivity type seventh transistor having a first electrode being connected to a first electrode of said sixth transistor, and a control electrode and a second electrode being connected to said second power source, a resistive element having an end being connected to a first electrode of said fifth transistor, a first conductivity type eighth transistor having a first electrode being connected to another end of said resistive element, and a second electrode and a control electrode being connected to said second power source, and a voltage being obtained from said first node is said control voltage, and a voltage being obtained from said second node is said constant voltage.

13. The voltage generation circuit in accordance with claim 4, further comprising:

first and second load elements being coupled in series between said first and second source voltages, a voltage being obtained from a node between said first and second load elements serving as a second control voltage, and second constant current supply means being interposed between said output terminal and said second power source for supplying a second constant current across said output terminal and said second power source at a current quantity being based on said second control voltage.

14. The voltage generation circuit in accordance with claim 13, wherein said constant current of said constant current supply means and said second constant current of said second constant current supply means satisfy both of the following conditions 1 and 2:

condition 1) said constant current and said second constant current exert no influence on said output voltage when said output voltage control operation by said differential amplification means and said voltage level shift means is functional to enable suppression of fluctuation in said output voltage; and condition 2) said output voltage is level-shifted toward said second source voltage on the basis of the current quantity of said constant current and that of said second constant current when said output voltage control operation by said differential amplification means and said voltage level shift means is unfunctional to disable suppression of fluctuation in said output voltage.

15. The voltage generation circuit in accordance with claim 14, wherein said voltage level shift means includes a first conductivity type first transistor having a control electrode receiving said amplified voltage, a first electrode being connected to said first power source, and a second electrode serving as said output terminal, said constant current supply means includes a second conductivity type second transistor having a control electrode receiving said control voltage, a first electrode being connected to said second power source, and a second electrode being connected to said output terminal, said second constant current supply means includes a second conductivity type third transistor having a control electrode receiving said second control voltage, a first electrode being connected to said second power source, and a second electrode being connected to said output terminal, and transistor sizes of said first, second and third transistors are in the ratios of 5:2:2.

16. The voltage generation circuit in accordance with claim 4, further comprising:

a high-pass filter receiving said control voltage and removing its low-frequency component for supplying the same to said constant current supply means.

* * * * *